US011452665B1

(12) United States Patent
Yu et al.

(10) Patent No.: US 11,452,665 B1
(45) Date of Patent: Sep. 27, 2022

(54) PRESSURE GENERATOR AND MASSAGER HAVING PRESSURE GENERATOR

(71) Applicant: SHENZHEN SVAKOM TECHNOLOGY CO., LTD, Shenzhen (CN)

(72) Inventors: Yong Yu, Shenzhen (CN); Minchao He, Shenzhen (CN); Yongqing Wang, Shenzhen (CN)

(73) Assignee: SHENZHEN SVAKOM TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/676,201

(22) Filed: Feb. 20, 2022

(30) Foreign Application Priority Data

May 22, 2021 (CN) ..... 202121128803.7
Jan. 8, 2022 (CN) ..... 202210018720.5

(51) Int. Cl.
*A61H 7/00* (2006.01)

(52) U.S. Cl.
CPC ..... *A61H 7/008* (2013.01); *A61H 2201/0169* (2013.01); *A61H 2201/1215* (2013.01); *A61H 2201/1669* (2013.01)

(58) Field of Classification Search
CPC ..... A61H 7/001–005; A61H 7/007; A61H 7/008; A61H 2201/1664; A61H 2201/1669
See application file for complete search history.

(56) References Cited

U.S. PATENT DOCUMENTS 4,513,737 A * 4/1985 Mabuchi ..... A61H 23/0254 601/108
4,566,442 A * 1/1986 Mabuchi ..... A61H 23/0254 601/101
8,951,216 B2 * 2/2015 Yoo ..... A61H 23/0254 601/84
10,667,830 B2 * 6/2020 Proctor ..... A61M 5/46
2003/0018284 A1 * 1/2003 Lim ..... A61H 23/02 601/102
2007/0150004 A1 * 6/2007 Colloca ..... A61H 1/008 606/237
2008/0262397 A1 * 10/2008 Habatjou ..... A61H 23/0254 601/134
2017/0065480 A1 * 3/2017 Howson ..... A61H 7/001
2020/0230012 A1 * 7/2020 Fuhr ..... A61H 23/00

* cited by examiner

*Primary Examiner* — LaToya M Louis

(57) ABSTRACT

The present invention discloses a pressure generator and a massager. The pressure generator includes a shell defining a first opening and a receiving space, a movable member extending into the receiving space and a drive device driving the movable member to reciprocally move within the receiving space. A gap is defined between the movable member and the inner wall of the shell.

14 Claims, 10 Drawing Sheets

PRESSURE GENERATOR AND MASSAGER HAVING PRESSURE GENERATOR

TECHNICAL FIELD

The present disclosure relates to the field of massaging devices, and in particular to a pressure generator and a massager.

BACKGROUND

With the accelerated pace of life, working pressures on people are increased. After daily working, a person may be tired, various portions of a body may ache. In order to relieve fatigue and soreness, people may take a variety of massagers to massage the body, such as a negative pressure massager. The negative pressure massager may adsorb and relax the skin to relieve the fatigue and soreness, so as to sooth the physically and mentally. However, the negative pressure massager in the related art may have a complicated structure, and may have a poor adsorption effect.

Therefore, the massager in the art needs to be improved to avoid the above defects.

SUMMARY OF THE DISCLOSURE

In one aspect, a pressure generator includes a shell, a movable member, and a drive device. The shell defines a first opening and a receiving space communicated to the first opening; the movable member is received in the receiving space; and the drive device is configured to drive the movable member to move reciprocally in the receiving space. A gap is defined between the movable member and an inner wall of the shell.

In another aspect, the present disclosure further provides a massager includes a support shell and a pressure generator. The support shell defines a third opening. The pressure generator is arranged on the support shell and includes: a shell, a movable member, and a drive device. The shell defines a first opening and a receiving space; the movable member is received in the receiving space; the drive device is configured to drive the movable member to move reciprocally in the receiving space; and a gap is defined between the movable member and an inner wall of the shell. The third opening is communicated to the first opening; and the drive device is received inside the support shell.

DETAILED DESCRIPTION

Figure 1:
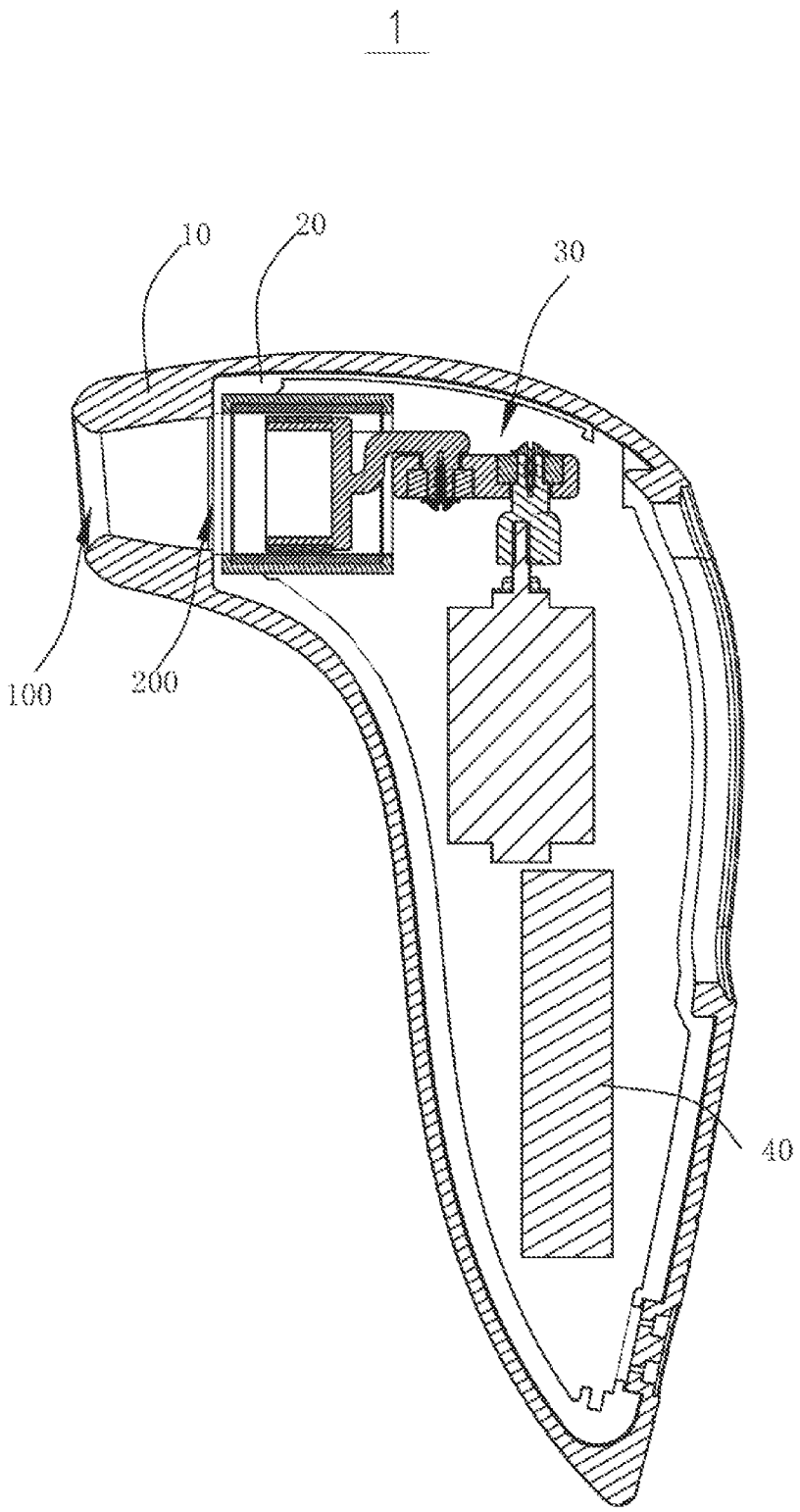
FIG. 1 is a structural schematic view of a massager according to an embodiment of the present disclosure.

Technical solutions in the embodiments of the present disclosure will be clearly and completely described below by referring to the accompanying drawings in the embodiments of the present disclosure. Obviously, the described embodiments are only a part of, but not all of, the embodiments of the present disclosure. All other embodiments obtained by a person of ordinary skill in the art based on the embodiments in the present disclosure and without making creative work shall fall within the scope of the present disclosure As shown in FIG. 1, the present disclosure provides a massager 1. The massager 1 is configured to massage a body of a user, especially to massage sensitive portions of the body. The massager 1 may generate a negative pressure to massage and stimulate the sensitive portions.

The massager 1 may include a support shell 20, a pressure generator 30 arranged inside the support shell 20, and a battery 40 arranged inside the support shell 20. The battery 40 is configured to provide power to the pressure generator 30. A flexible sleeve 10 may be arranged to sleeve an outside of the support shell 20, and the flexible sleeve 10 is configured to contact the human body. The flexible sleeve 10 defines an adsorption port 100, and a periphery of a wall of the adsorption port 100 is configured to contact a skin of the user. The support shell 20 defines a third opening 200 communicated to the adsorption port 100. Periodic alternating positive and negative pressures generated by the pressure generator 30 may be conducted to the skin through the third opening 200 to stimulate the skin and achieve a massaging effect.

The flexible sleeve 10 may be made of a skin-friendly material, such as silicon, to improve the user experience.

The pressure generator 30 may be implemented by taking specific structures shown in the following embodiments.

Embodiment I

Figure 2:
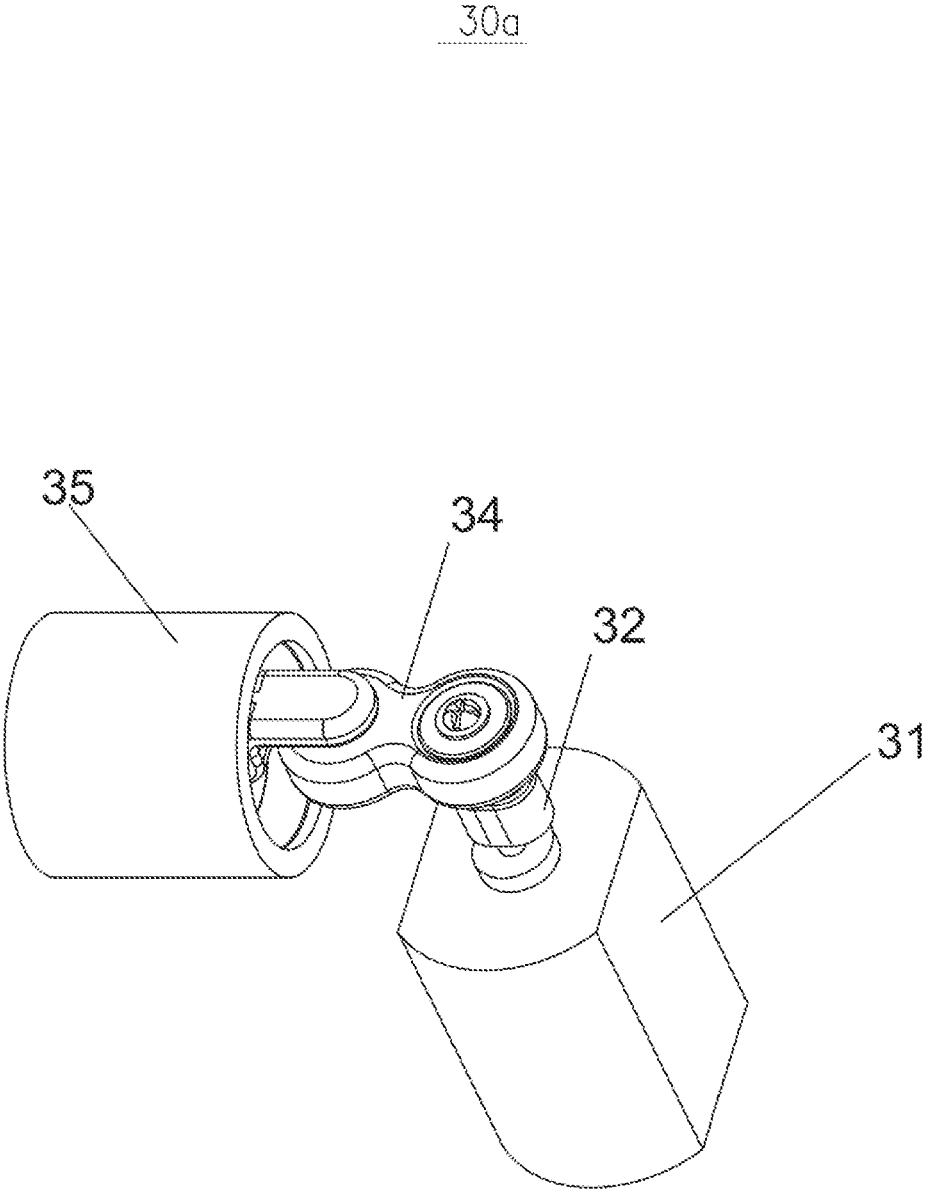
FIG. 2 is a structural schematic view of a first embodiment of the pressure generator shown in FIG. 1.
Figure 3:
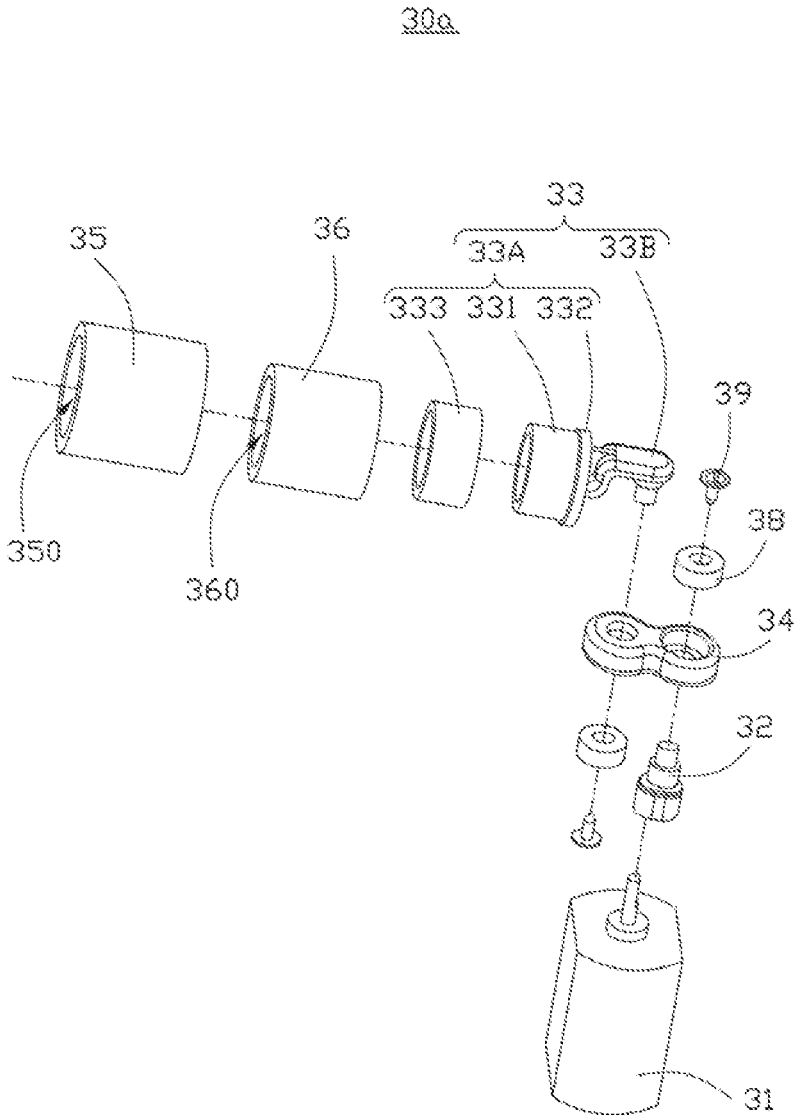
FIG. 3 is an explosive schematic view of the first embodiment of the pressure generator.
Figure 4:
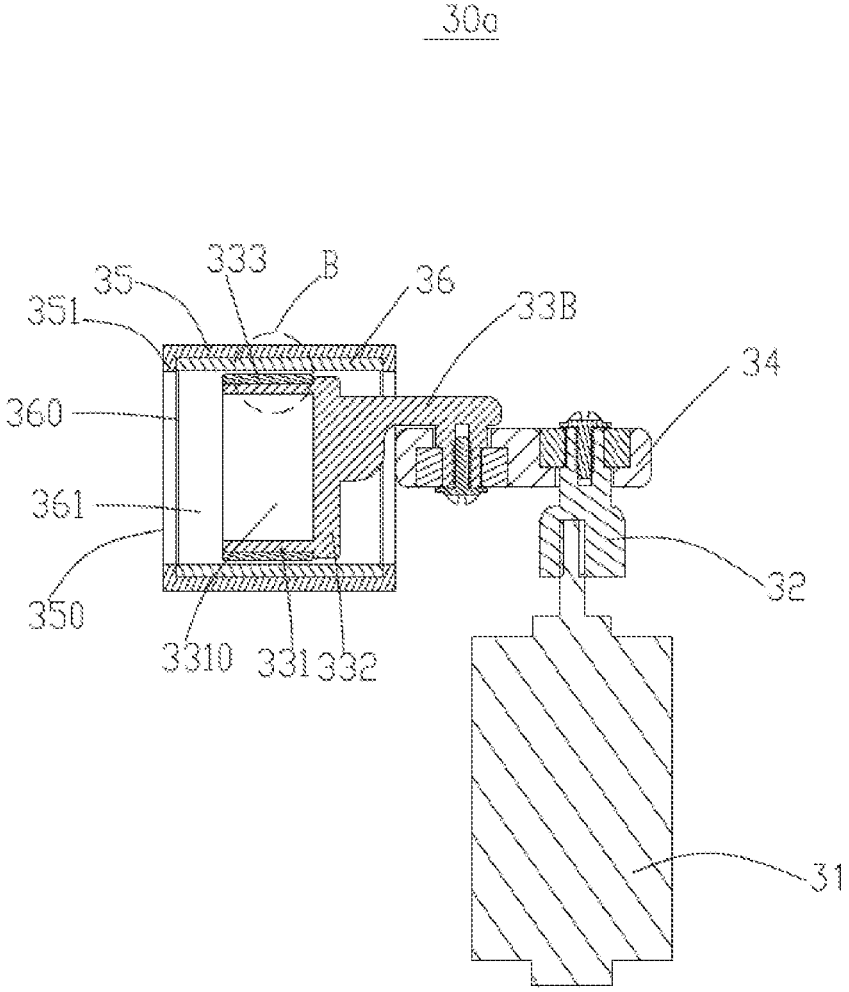
FIG. 4 is a cross sectional view of the pressure generator shown in FIG. 2.

As shown in FIGS. 2-4, the present disclosure provides a first embodiment of a pressure generator 30*a*. The pressure generator 30*a* includes a shell 36 defining a receiving space 361, a movable member 33 movably extending into the receiving space 361, and a driving device. The driving device drives the movable member 33 to move along the receiving space 361 reciprocally and linearly. The shell 36 defines a first opening 360 communicated to the receiving space 361. A gap 300 is defined between the movable member 33 and an inner wall of the shell 6.

In detail, the movable member 33 includes a free end 33A and a drive end 33B. A cavity 3310 is defined in the free end 33A. The free end 33A includes a bottom wall 332 connected to the drive end 33B and a side wall 331 extending from the bottom wall 332 towards the first opening 360. The bottom wall 332 and the side wall 331 cooperatively define the cavity 3310. The cavity 3310 is communicated to the receiving space 361. The cavity 3310 allows a volume of the receiving space to be increased so that the pressure generator 30*a* has a large pressure variation range and a large pressure variation space. At the same time, the cavity 3310 increases a contact area between the movable member 33 and air in the receiving space 361, such that the movable member 33 may be subjected to a uniform force while moving, and the movable member 33 may move stably.

The free end 33A further includes a sleeve ring 333 sleeving the side wall 331. The sleeve ring 333 is made of a metal, preferably made of aluminum alloy and the like. In the present embodiment, the gap is defined between the sleeve ring 333 and the inner wall of the shell 36. As desired, an outer diameter of the bottom wall 332 is greater than an outer diameter of the side wall 331, thereby forming a limiting stage to position the sleeve ring 333. In the present embodiment, the movable member 33 includes a piston.

In the present embodiment, the pressure generator 30*a* further includes a protective sleeve 35. The protective sleeve 35 is made of a cushioning material and sleeves an outside of the shell 36. The protective sleeve 35 defines a second opening 350 communicated to the first opening 360. The protective sleeve 35 is made of a cushioning material, such as silicone and the like. As shown in FIG. 1, the protective sleeve 35 is disposed between the support shell 20 and the shell 36. By arranging the protective sleeve 5, transmission of vibration to the outside may be reduced, and on the other hand, transmission of noise, which is generated due to the movable member 33 moving while the movable member 33 contacts the shell 36, to the outside may be reduced, such that noise may be reduced.

Only when the gap 300 is not greater than 0.1 mm, a dynamic pressure may be generated at the second opening 350 and the first opening 360, i.e., the negative pressure may be generated at the second opening 350 and the first opening 360. By defining the gap 300 to be smaller, a larger noise may be prevented while using the massage 1, achieving a noise reduction. In use, the drive device may be arranged to allow the movable member 33 (such as the piston) to move along a length direction in the shell 36 reciprocally. When the adsorption port 100 of the massager 1 is attached to the skin, the second opening 350 is covered. The movable member 33 moving reciprocally may change a volume of the receiving space defined by the shell 36. In this way, an internal air pressure is dynamically changed, even when the receiving space defined by the shell 36 generates the alternating positive and negative pressures. Preferably, the gap 300 is not greater than 0.05 mm.

Figure 5:
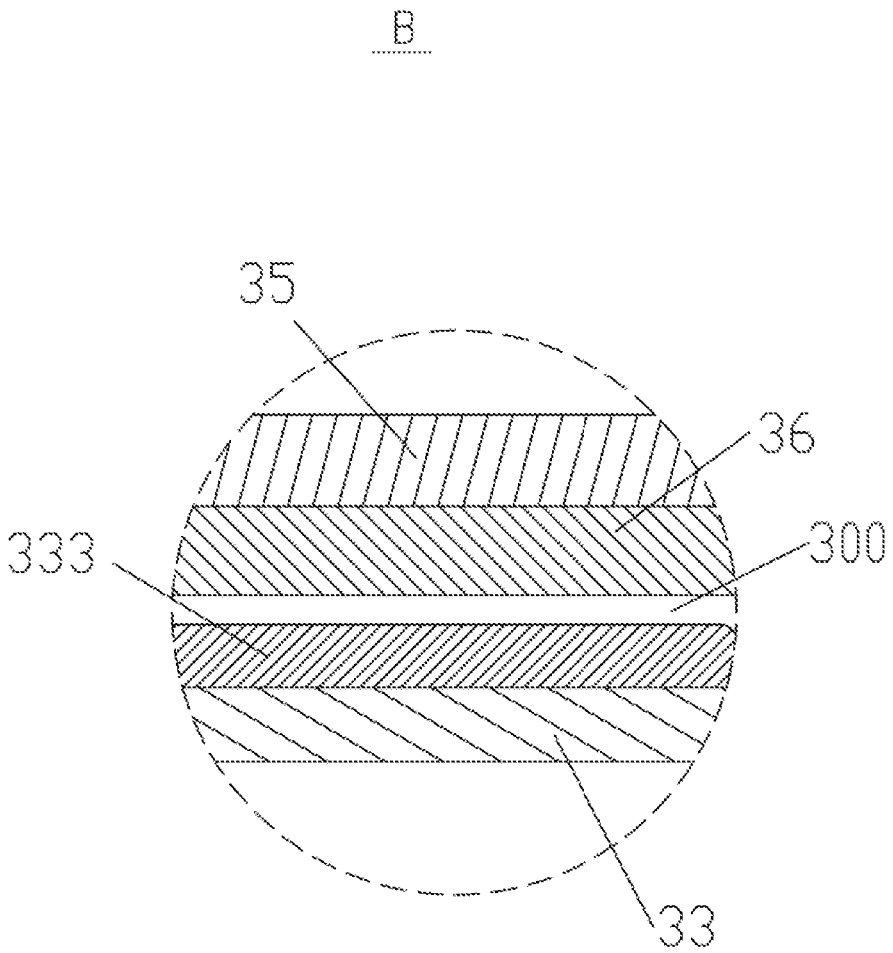
FIG. 5 is an enlarged structural schematic view of a portion B shown in FIG. 2.

In the present embodiment, as shown in FIG. 5, a block 351 is arranged at each of two ends of the protective sleeve 35, and the block 351 extends towards the receiving space. Two blocks 351 define a receiving cavity of the shell 36. The outside of the shell 36 is sleeved by the protective sleeve 35 for wrapping, which can further reduce noise. The block 351 may be a convex block, and a plurality of blocks 351 may be spaced apart from each other and disposed between the two ends of the protective sleeve 35. Alternatively, the block 351 may be a ring-shaped wall, and two blocks 351 may be disposed at the two ends of the protective sleeve 35 respectively.

Figure 6:
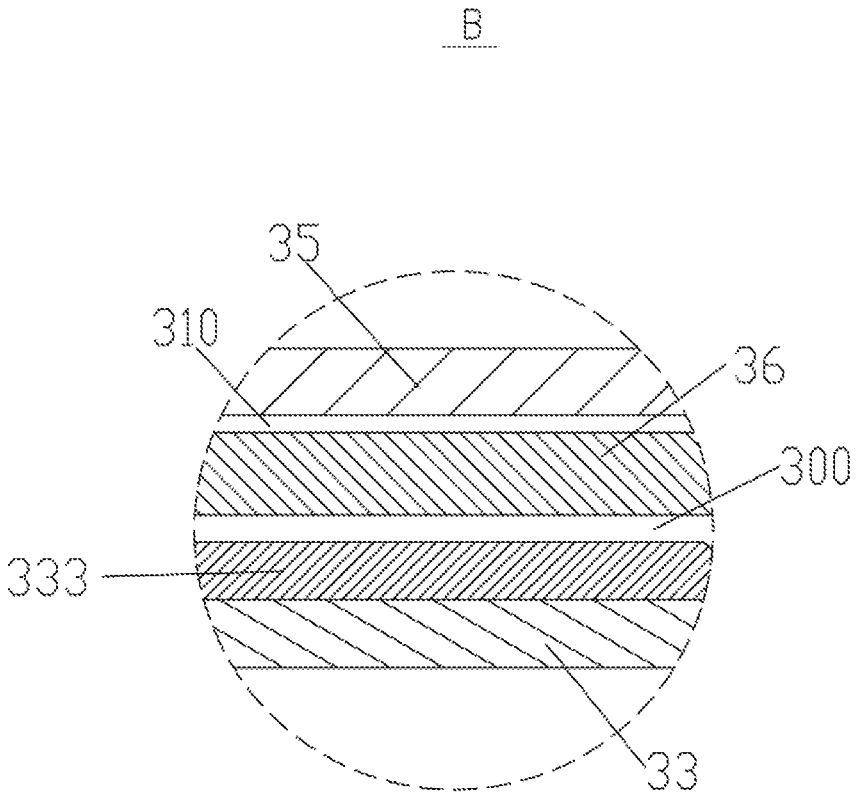
FIG. 6 is an enlarged structural schematic view of another embodiment showing the portion B in FIG. 2.
Figure 7:
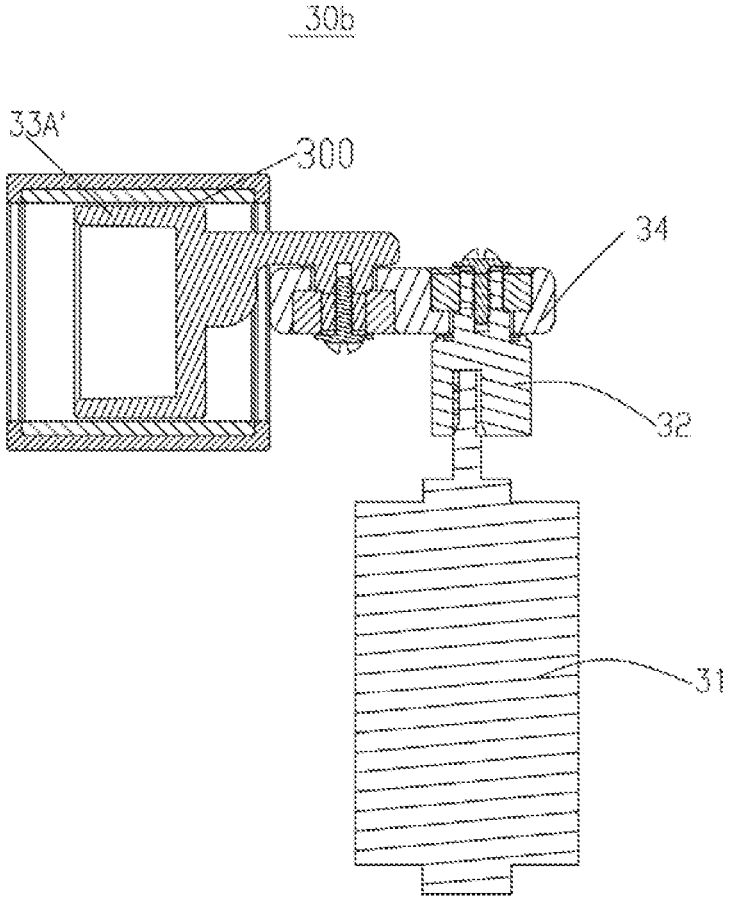
FIG. 7 is a cross sectional view of the pressure generator of a second embodiment shown in FIG. 2.

As shown in FIG. 6, the protective sleeve 35 and the shell 36 may be spaced apart from each other to define a sound insulation space 310. The sound insulation space 310 prevents the noise, which is generated by the reciprocating movement of the movable member 33, from transmitting to the outside, thus further reducing the noise. As needed, the sound insulation space 310 may preferably be a vacuum, which has a better effect to reduce the noise.

The drive device includes a motor 31 and an eccentric member 32 arranged on a shaft of the motor 31. The eccentric member 32 is movably connected to the drive end 33B through a connecting rod 34. A bearing 38 may be disposed between the connecting rod 34 and the drive end 33B, and another bearing 38 may be disposed between the connecting rod 34 and the eccentric member 32. The bearing 38 is fixed to the eccentric member 32 through a screw 39 to allow the connecting rod 34 and the eccentric part 32 to rotate stably. The another bearing 38 is fixed to a fixed protrusion on the drive end 33B through another screw 39 to allow the connecting rod 34 and the drive end 33B to rotate stably.

Embodiment II

The present disclosure further provides another embodiment of a pressure generator 30*b*. The pressure generator 30*b* differs from the pressure generator 30*a* in the above embodiment only in that: the sleeve ring 333 and the side wall 331 of the movable member 33 are configured as a one-piece structure. The one-piece structure is plastic. Preferably, the sleeve ring 333 and the side wall 331 are formed as one piece by injection molding. Other structures of the pressure generator 30*b* are the same as those in the first embodiment, and will not be repeated.

Embodiment III

Figure 8:
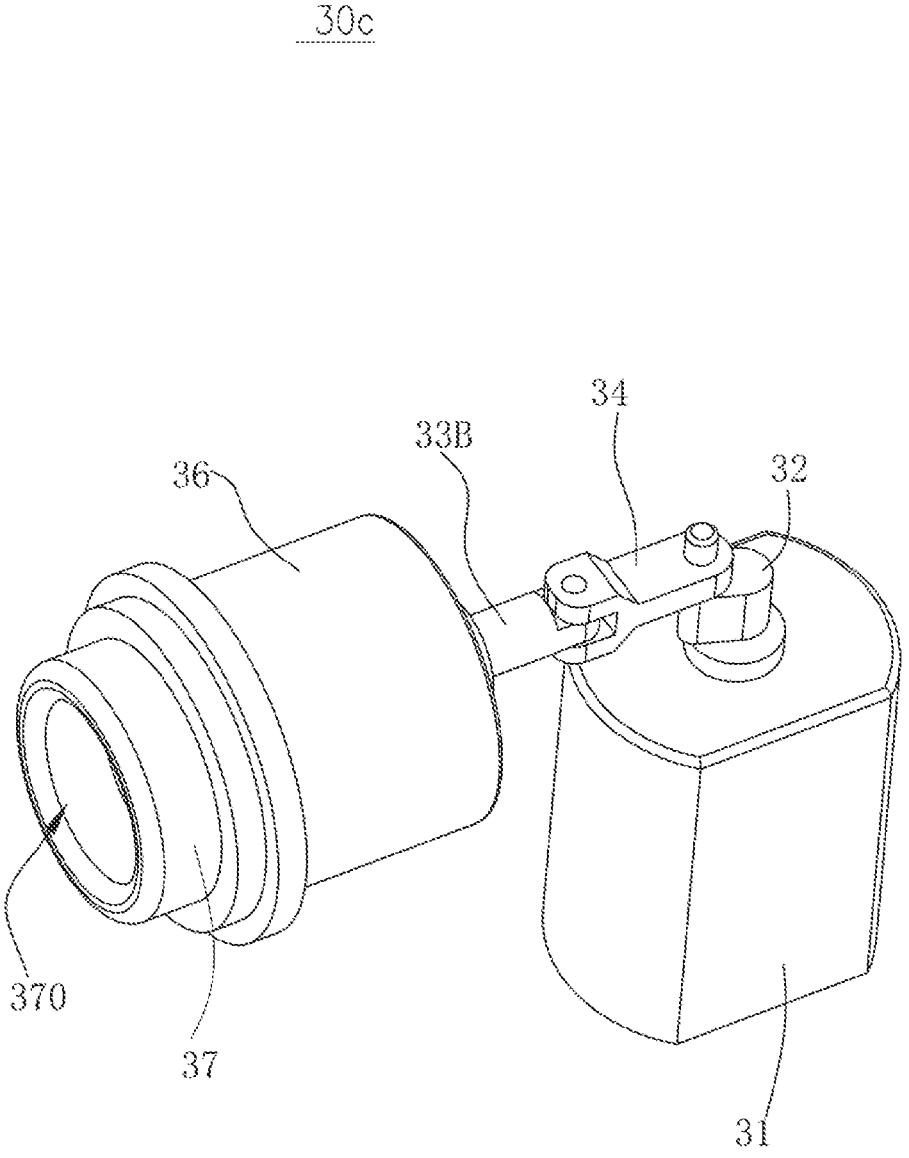
FIG. 8 is a structural schematic view of a third embodiment of the pressure generator shown in FIG. 1.
Figure 9:
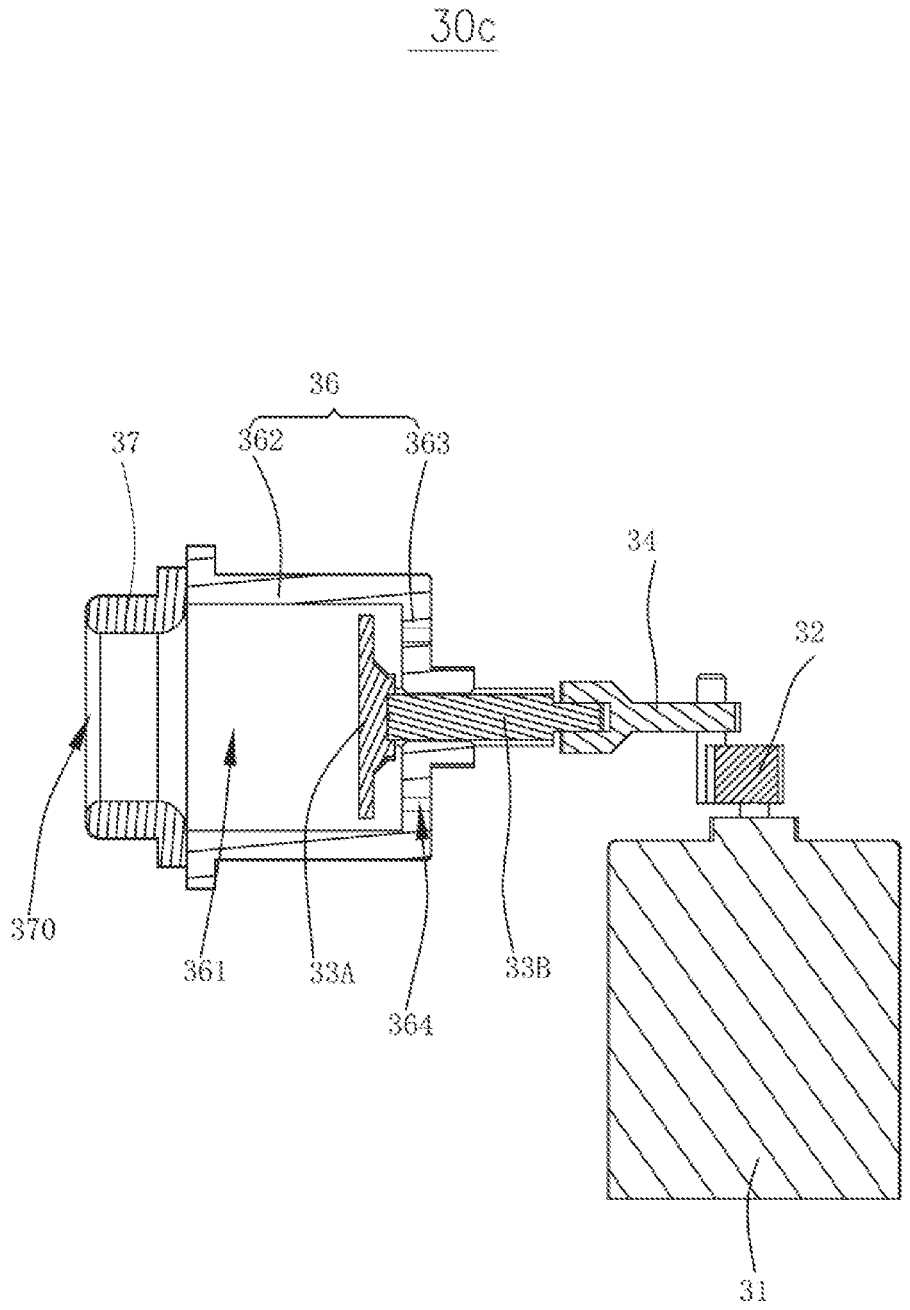
FIG. 9 is a cross sectional view of the pressure generator shown in FIG. 8.

As shown in FIGS. 8 and 9, a pressure generator 30*c* in the Embodiment III differs from the pressure generator 30*a* in the Embodiment I in the following aspects.

As shown in FIG. 9, the free end 33A may be in a shape of a flat plate.

In the present embodiment, the pressure generator 30*c* further includes an adsorption member 37 connected to the shell 36. An end of the adsorption member 37 defines an adsorption port 370. The adsorption port 370 is communicated to the first opening 360. The periodic alternating positive and negative pressures may also be generated at the adsorption port 370.

In the present embodiment, the adsorbent member 37 is integrally formed with the shell 36. It shall be understood that, in other embodiments, the adsorbent member 37 and the shell 36 may be connected by glue or the like. When the adsorbent member 37 is arranged in the massager 1, the adsorption member 37 may be integrally formed or separately formed with the flexible sleeve 10.

The shell 36 includes a first cavity wall 361 and a second cavity wall 363. The first cavity wall 361 extends in a direction of the movement of the movable member 33 and encloses to define the first opening 360. The second cavity wall 363 is disposed at an end of the first cavity wall 361 away from a first opening 360. The gap 300 is defined between the movable member 33 and the first cavity wall 361. The second cavity wall 363 movably extends through the drive end 33B. The drive end 33B connects to the movable member 33 and the drive device, such that the drive device drives the drive end 33B to further drive the movable member 33 to reciprocally move within the shell 36.

In the present embodiment, the second cavity wall 363 defines a leaking hole 364. The leaking hole 364 extends through the second cavity wall 363 along the movement direction of the movable member 33.

The drive device includes a transmission assembly 32 and a motor 31. The motor 31 is connected to the drive end 33B through the transmission assembly 32. The drive assembly 32 may be any one of an eccentric transmission structure, a cam, and a rolling ball screw.

In the present embodiment, the transmission assembly is the eccentric transmission structure. The transmission assembly 2 includes an eccentric member 32 and a connecting rod 34 that are transmittably connected to each other.

The eccentric member 32 is connected to the motor 31, and the connecting rod 34 is connected to the drive end 33B.

When the pressure generator is operating, the adsorption port 370 is placed at a part of the body that needs massage. The motor 31 drives the movable member 33 to reciprocally move in the shell 36 by driving the eccentric member 32, the connecting rod 34 and the driving end 33B successively. In this way, the periodic alternating positive and negative pressures may be generated at the adsorption port 370, achieving the effect of adsorption and relief.

Embodiment IV

Figure 10:
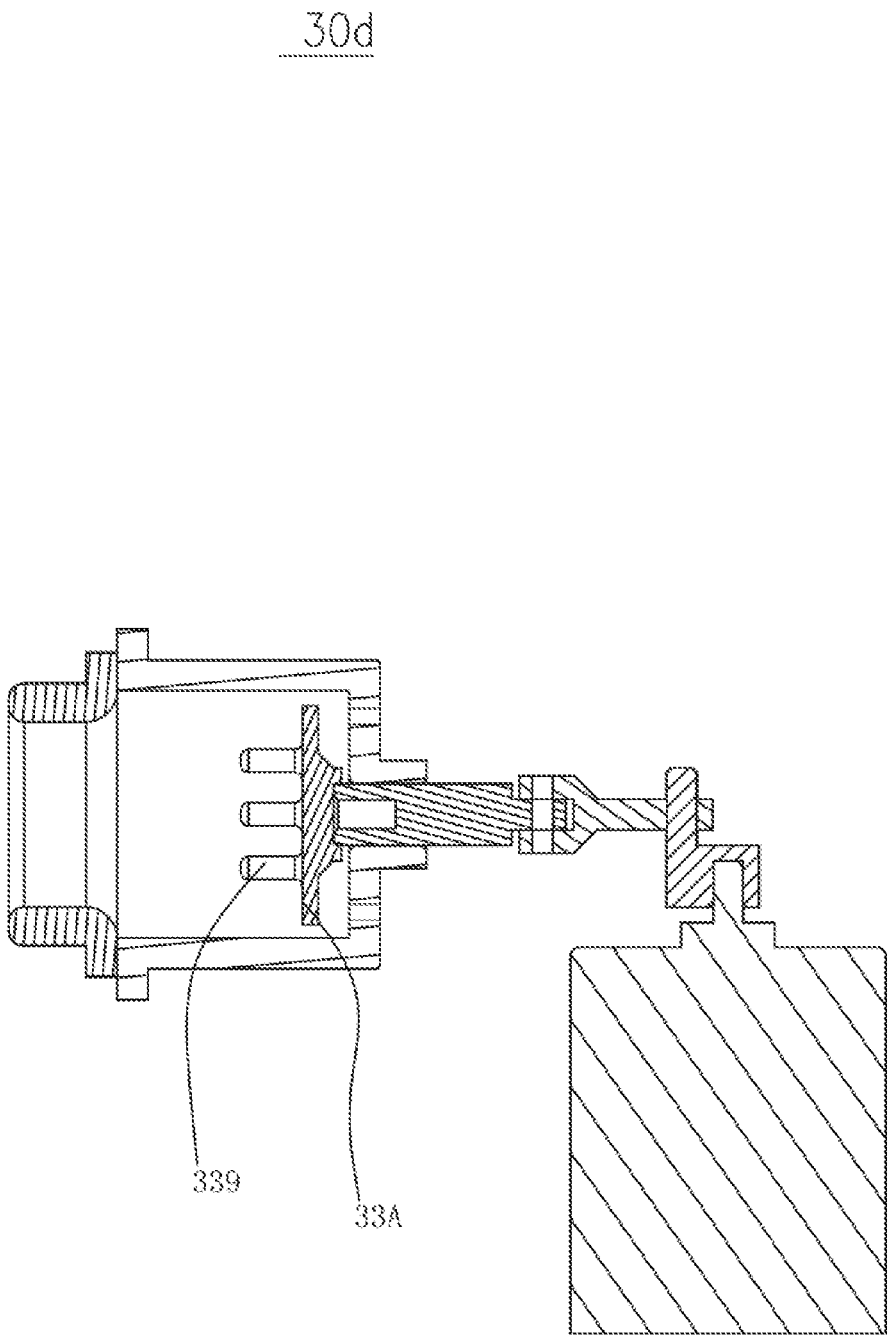
FIG. 10 is a structural schematic view of a fourth embodiment of the pressure generator shown in FIG. 1.

As shown in FIG. 10, a difference between a pressure generator 30*d* in the fourth embodiment and the pressure generator 30*c* in the third embodiment includes following aspects.

In the fourth embodiment, a plurality of protrusions 339 may be arranged on a side of the movable member 33 facing the first opening 360. While the movable member 33 is moving reciprocally towards the first opening 360, the plurality of protrusions 339 may at least partially protrude out of the absorption port 370. In detail, when the movable member 33 moves towards the first opening 360 to reach a position closest to the first opening 360, the plurality of protrusions 339 may at least partially protrude out of the absorption port 370. In this way, the plurality of protrusions 339 may massage the body.

To be noted that, a structure of the drive device is not limited to the structure shown in the first and the second embodiment. For example, the drive device may be an electromagnetic drive member. The electromagnetic drive member includes a first magnetic member and a second magnetic member connected to the drive end. One of the first magnetic member and the second magnetic member includes wires, and the other of the first magnetic member and the second magnetic member includes a magnet. When the wire is conducted, a force between the first magnetic member and the second magnetic member may drive the movable member to move reciprocally.

The magnet may be a permanent magnet or an electric magnet.

The above description shows implementations of the present disclosure only. To be noted that, any ordinary skilled person in the art may perform improvement on the embodiments without departing from the concept of the present disclosure, and the improvement shall be included in the scope of the present disclosure.

What is claimed is:

1. A pressure generator, comprising a shell, a movable member, and a drive device, wherein the shell defines a first opening and a receiving space communicated to the first opening;

the movable member is received in the receiving space;

the drive device is configured to drive the movable member to move reciprocally in the receiving space; and a gap is defined between the movable member and an inner wall of the shell, the gap is not greater than 0.1 mm.

2. The pressure generator according to claim 1, wherein the gap is not greater than 0.05 mm.

3. The pressure generator according to claim 1, further comprising a protective sleeve, wherein the protective sleeve is made of a cushioning material;

the protective sleeve is configured to sleeve an outside of the shell;

the protective sleeve defines a second opening communicated to the first opening.

4. The pressure generator according to claim 3, wherein the protective sleeve and the shell are spaced apart from each other to define a sound insulation space.

5. The pressure generator according to claim 1, wherein the movable member comprises a drive end connected to the drive device and a free end connected to the drive end, and the free end defines a cavity communicated to the receiving space.

6. The pressure generator according to claim 5, wherein the free end comprises a bottom wall connected to the drive end and a side wall extending from the bottom end towards the first opening, and the side wall and the bottom wall cooperatively define the cavity.

7. The pressure generator according to claim 6, wherein the gap is defined between the side wall and the inner wall of the shell.

8. The pressure generator according to claim 6, wherein the free end further includes a sleeve ring sleeving the side wall, and the gap is defined between the sleeve ring and the inner wall.

9. The pressure generator according to claim 8, wherein the drive device comprises a motor and an eccentric member arranged on a shaft of the motor, the eccentric member is movably connected to the transmission member through a connecting rod, and a bearing is arranged between the connecting rod and the transmission member, another bearing is arranged between the connecting rod and the eccentric member.

10. The pressure generator according to claim 1, wherein a protrusion is arranged on a side of the movable member facing the first opening, and the protrusion at least partially extends out of the first opening.

11. A massager, comprising:

a support shell, defining a open pore;

a pressure generator, arranged on the support shell and comprising: a shell, a movable member, and a drive device, wherein the shell defines a first opening and a receiving space; the movable member is received in the receiving space; the drive device is configured to drive the movable member to move reciprocally in the receiving space; and a gap is defined between the movable member and an inner wall of the shell, the gap is not greater than 0.1 mm;

wherein the open pore is communicated to the first opening; and the drive device is received inside the support shell.

12. The massager according to claim 11, wherein the gap is not greater than 0.05 mm.

13. The massager according to claim 11, Wherein the pressure generator further comprises a protective sleeve, wherein the protective sleeve is made of a cushioning material;

the protective sleeve is configured to sleeve an outside of the shell;

the protective sleeve defines a second opening communicated to the first opening.

14. The massager according to claim 13, wherein the protective sleeve is disposed between the support shell and the shell.

* * * * *